US005300989A

United States Patent [19]

Shakib

[11] Patent Number: 5,300,989

[45] Date of Patent: Apr. 5, 1994

[54] TOP DELIVERY LIQUID TONER IMAGING APPARATUS

[75] Inventor: Iraj D. Shakib, Lexington, Ky.

[73] Assignee: Lexmark International, Inc., Greenwich, Conn.

[21] Appl. No.: 945,193

[22] Filed: Sep. 15, 1992

[51] Int. Cl.[5] ..... G03G 15/10

[52] U.S. Cl. ..... 355/256; 355/272; 355/277; 355/285; 355/290; 358/498

[58] Field of Search ..... 355/282, 285, 289, 290, 355/295, 271, 272, 273, 277, 279; 219/216; 358/496, 497, 498, 296; 346/146

[56] References Cited

U.S. PATENT DOCUMENTS

| | | | |
|---|---|---|---|
| 3,062,533 | 11/1962 | Eichler et al. | 271/36 |
| 3,945,726 | 3/1976 | Ho et al. | 219/216 X |
| 4,455,079 | 6/1984 | Miwa et al. | 355/279 |
| 4,518,976 | 5/1985 | Tarumi et al. | 346/153.1 |
| 4,719,489 | 1/1988 | Ohkubo et al. | 219/216 X |
| 4,755,949 | 7/1988 | Tarumi et al. | 355/216 X |
| 4,943,831 | 7/1990 | Geraets et al. | 355/290 |
| 5,041,718 | 8/1991 | d'Hondt et al. | 355/282 X |
| 5,083,165 | 1/1992 | Landa | 355/256 |
| 5,117,263 | 5/1992 | Adam et al. | 355/256 |
| 5,138,392 | 8/1992 | Kinoshita et al. | 355/289 |
| 5,148,222 | 9/1992 | Lior et al. | 355/256 |

FOREIGN PATENT DOCUMENTS

| | | | |
|---|---|---|---|
| 57-2048 | 1/1982 | Japan | G03G 13/16 |
| 62-134674 | 6/1987 | Japan | G03G 15/16 |
| 62-240987 | 10/1987 | Japan | G03G 15/16 |
| 63-34572 | 2/1988 | Japan | G03G 15/16 |
| WO92/10793 | 6/1992 | PCT Int'l Appl. | G03G 15/16,15/01 |

*Primary Examiner*—Leo P. Picard
*Assistant Examiner*—Christopher Horgan
*Attorney, Agent, or Firm*—John A. Brady

[57] ABSTRACT

A compact printer for liquid toning having a second transfer roller (19) located above a larger, first transfer roller (15). Paper is stored in an lower internal tray (23), moved vertically past the transfer roller (15), and then imaged and fixed at the nip of the second transfer roller and a fixing roller (21) as it is delivered to the top (39) of the printer.

6 Claims, 3 Drawing Sheets

TOP DELIVERY LIQUID TONER IMAGING APPARATUS

RELATED APPLICATION

U.S. patent application entitled Imaging Apparatus With Straight Path Fixing filed the same date as this invention and for which the inventor of this application is a joint inventor is directed to coverage related to a printer with fixing as disclosed in this application.

TECHNICAL FIELD

This invention relates to electrophotographic printing, and copying and, more specifically, office or "personal" size devices in which the final paper is conveniently delivered to the user.

BACKGROUND OF THE INVENTION

Electrophotographic imaging employing liquid toner is an established technology. U.S. Pat. No. 5,083,165 to Landa is illustrative. In such systems the effects of gravity on the flow of toner must be taken into account.

U.S. Pat. No. 4,755,849 to Tarumi et al discloses embodiments of an electrophotographic imaging system having an intermediate image transfer member, transfer and fixing with heat and by contact between the transfer member and an opposing roller.

U.S. Pat. No. 4,455,079 to Miwa et al discloses a preheating member on the print-receiving side of the paper curved around a pressure roller. Similarly, U.S. Pat. No. 4,518,976 to Tarumi et al discloses a preheating member on the print-receiving side of the paper curved around the pressure roller as well at least one other embodiment (FIG. 10) in which the heating is to the opposite side.

DISCLOSURE OF THE INVENTION

This invention is a liquid toner in electrophotographic imaging device of compact size achieved by having a first intermediate transfer member to which the toned image is transferred from the photoconductor by contact and a second intermediate transfer member to which the image is transferred from the first transfer member. The second transfer member generally above the first transfer member and is much smaller. Paper is delivered to a nip location between the second transfer member and a rotating fixing member with heat. Paper exiting this nip is delivered to the top of the device.

This configuration permits photoconductor and a developer member, which turns opposite the photoconductor to be positioned under the liquid toner source. This results in the photoconductor moving in the direction of gravity to that location which is essential to the best function. Paper may be fed toward the operator, which is especially convenient, and paper to be imaged may be stored within the printer.

BRIEF DESCRIPTION OF THE DRAWINGS

The details of this invention will be described in connection with the accompanying drawings, in which.

BEST MODE FOR CARRYING OUT THE INVENTION

Figure 1:
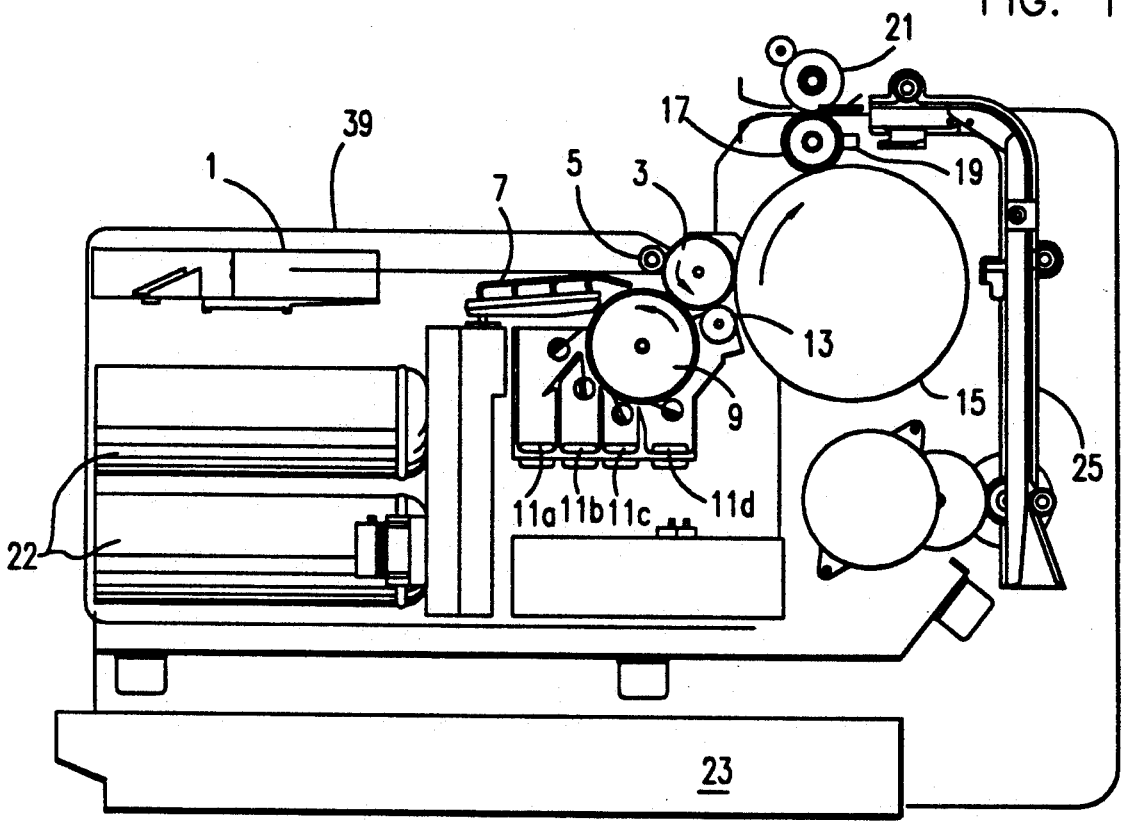
FIG. 1 depicts the internal configuration of a printer employing this invention.

As shown in FIG. 1, a laser printhead 1 operates on a photoconductive drum 3 which is electrically charged by a charge roller 5. (Drum 3 is a roller, the term drum being commonly used because it has an empty interior.) Liquid toner is applied by nozzles between drum 3 and a countermoving roller 9. At the nip location of drum 3 and roller 9, drum 3 moves in the direction of gravity. Toner is applied sequentially in three colors and in black to form a full-spectrum, colored image. That toner which is not captured by the drum 3 is moved by roller 9 and directed to a tank 11*a*, 116, 11*c*, & 11*d* corresponding to the color of the toner. Squeegee roller 13 removes excess liquid from drum 3.

Each toned image is transferred by contact with accumulator drum 15. (Drum 15 is a roller, the term drum being commonly used because it has an empty interior.) For a colored image, drum 3 separately receives the image from laser 1 of each of the three colors and black, and each image is separately developed and transferred to accumulator drum 15 in registration with the other images. Until the four images are on drum 15, transfer roller 17 is spaced away from drum 15. To apply the images to final paper, transfer roller 17 is moved laterally by solenoid 19 into contact with drum 15. Transfer roller 17 may be much smaller than accumulator drum 15 since it need not hold a full-page image simultaneously. It is electrically biased to attract toner from drum 15 at the location of nip contact between drum 15 and roller 17. Specifically, the diameter of roller 17 is about one-fifth the diameter of drum 15. Roller 17 is positioned above near the top of drum 15.

Fixing roller 21 opposes roller 17 to form a pressure nip for the final transfer and fixing on paper.

The imaging operation of the foregoing need not be novel to implement this invention and therefore is described only generally and illustratively. The printer would have a number of elements not specifically mentioned such as a cleaning mechanism for drum 3 and toner resupply mechanism 22 which is shown in general outline located under laser 1.

Figure 2:
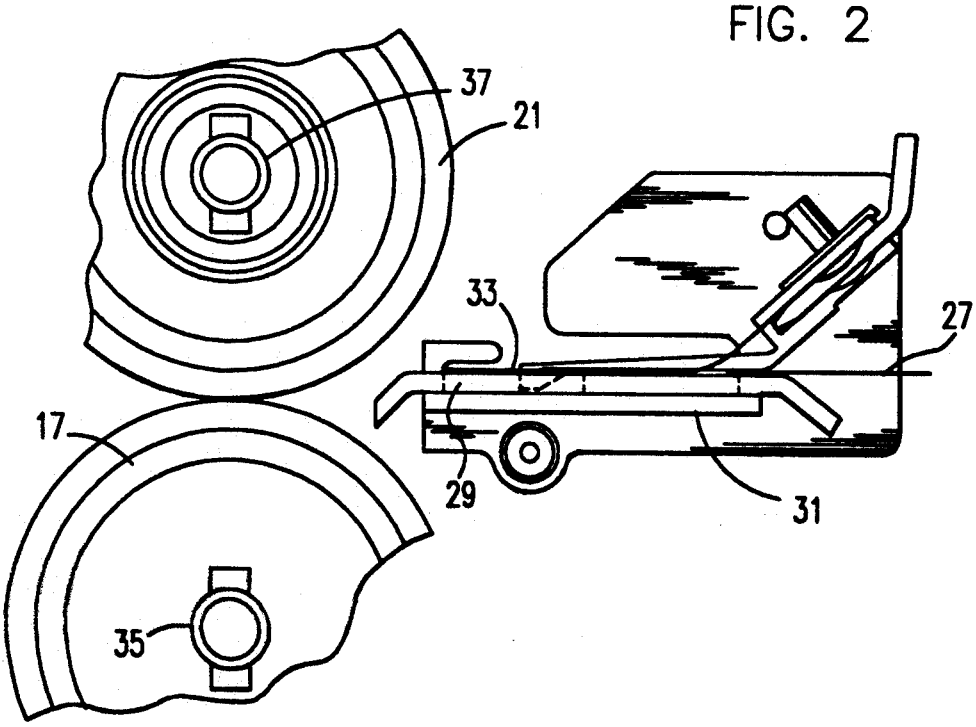
FIG. 2 is a side view of the fixing members.
Figure 3:
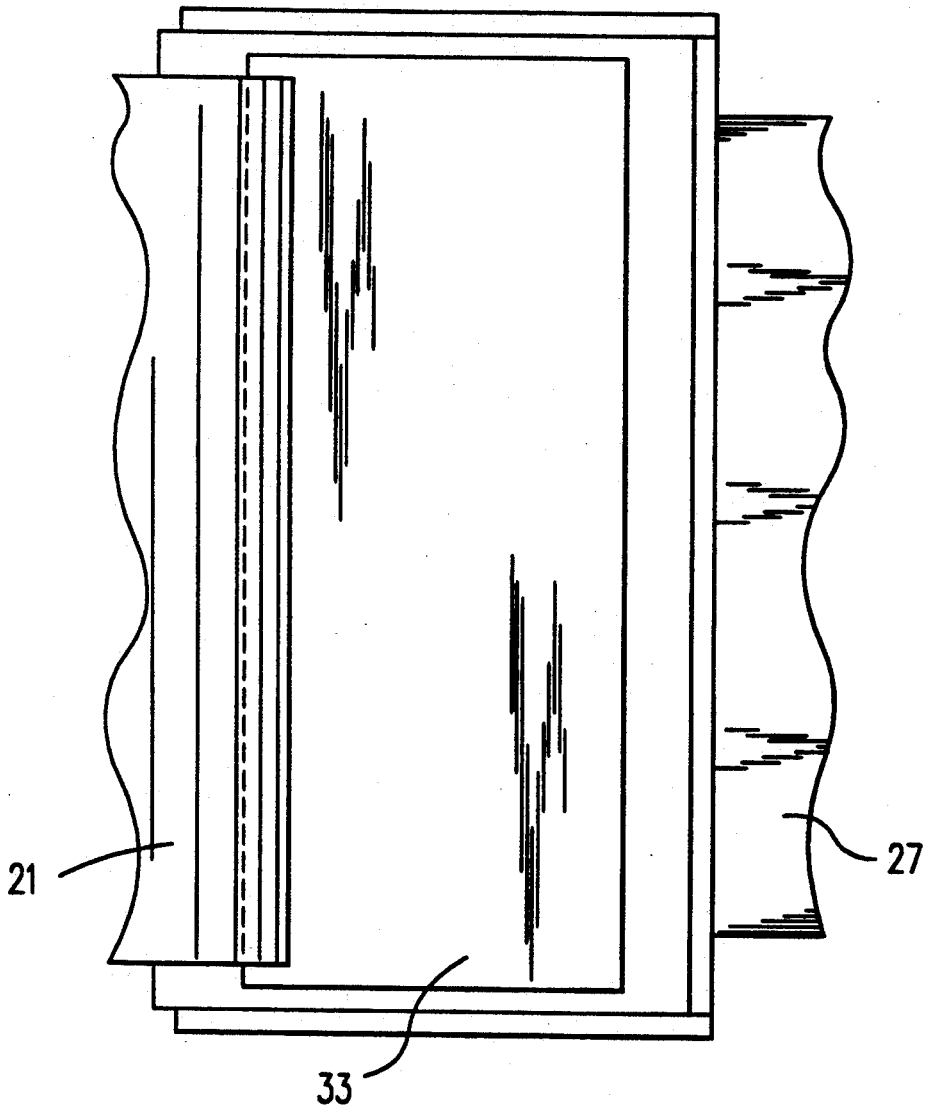
FIG. 3 is a top view of the fixing members.

Paper for the final image is stored in the bottom of the device chamber or in tray 23 and moves through a guide track 25, which may be conventional, prior to preheating for fixing. Guide track 25 includes a generally vertical section located between drum 15 and the back of the apparatus. FIG. 2 illustrates paper 27 where it contacts a flat surface of preheating plate 29 which faces roller 21 and is heated by an electrical heating element 31. This occurs as the paper is moved steadily toward the nip of rollers 17 and 21. Direct contact of paper 27 with plate 29 is assured by flat spring 33 bent against plate 29. Both rollers 17 and 21 have conventional, internal heating lamps 35 and 37 respectively. The plane of plate 29 contains the extended tangent line of the nip of rollers 17 and 21. Accordingly, the fixing path of paper 27 is straight and no curling of paper 27 is experienced even though the fixing temperatures are high enough to fix a mineral oil vehicle liquid toner before the oil separates from the solids.

Liquid toner has a low surface energy and low cohesive strength which causes the toner, when molten, to tend to adhere to fusing surfaces. The result is degraded image and fuser roll contamination. Fusing before the vehicle separates into the paper reverses this tendency.

No silicone oil or other outside release agent need be employed in the embodiment shown.

Figure 4:
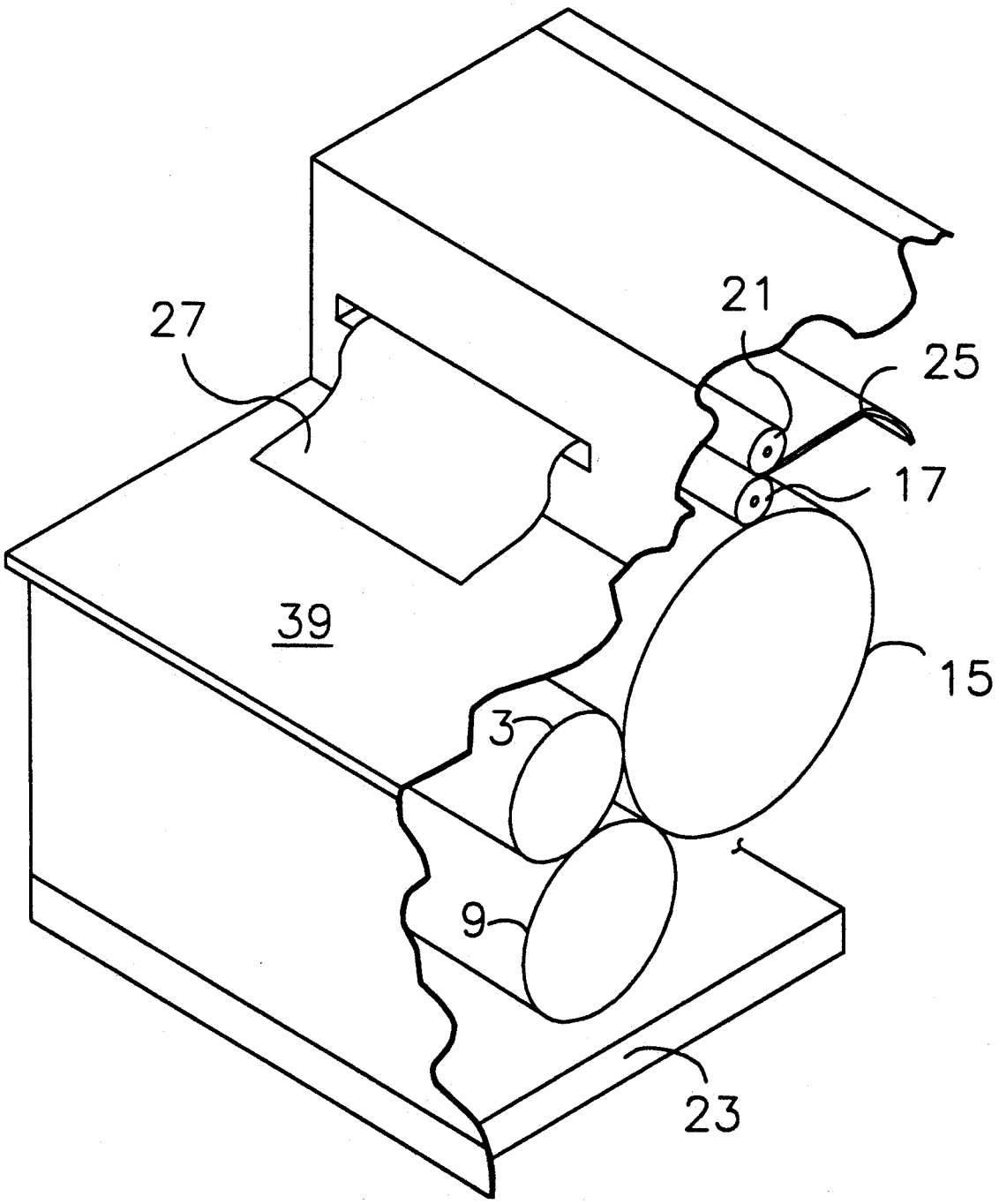
FIG. 4 is a perspective view from the top partially sectioned to show certain elements significant to this invention.

FIG. 4 shows a printer from the top with paper 27 being exited from the rear onto a top tray, 39. This is highly convenient to an operator since operators are normally positioned at the front of printers and other imaging apparatus. As suggested in FIG. 4 the imaging system employing rollers and drums 3, 9, 15, 17 and 21 is at least coextensive with the width of paper 27.

It will be recognized that implementations can take various forms, all within the spirit and scope of this invention.

What is claimed is:

1. An electrophotographic printer comprising an endless photoconductive surface moveable in one direction, an output tray located at the top, front of said printer, means for charging said photoconductive surface, a laser printhead located under said output tray and between said photoconductive surface and said front of said printer, for exposing said charged surface to an optical image to at least partially discharge said charged surface in the pattern of said images, a first endless surface forming a first nip with said photoconductive surface moveable at said nip, means to develop said image on said photoconductive surface by applying liquid toner to said first nip from above said first nip, the movement of said photoconductive surface in said one direction at said first nip being with the direction of gravity, and endless first transfer roller to receive said toned image from said photoconductive surface by contact with said photoconductive surface, an endless second transfer roller of diameter one-third or less of the diameter of said first roller positionable above said first transfer roller to receive said toned image from said first transfer roller by contact with said first transfer roller, a third roller positioned to form a second nip with said second transfer roller, and paper feed means to move paper or other image receiving substrate to said second nip where said paper or other substrate receives said image while said paper is moved to exit said apparatus on to said output tray, said output tray being readily accessible to an operator of said printer positioned at said front of said printer.

2. The printer as in claim 1 having a paper supply chamber at the bottom of said printer and a vertical paper feed path at the back of said printer.

3. An electrophotographic printer comprising a photoconductive roller moveable in one direction, an output tray located at the top, front of said printer, means for charging said photoconductive roller, a second roller located to form a first nip with said photoconductive roller and moveable at said first nip in a direction opposite to said one direction, a laser printhead located under said output tray and between said photoconductive roller and said front of said printer for exposing said charged surface to an optical image to at least partially discharge said charged surface in the pattern of said image, liquid toner means comprising liquid toner discharge means directed from above said first nip toward said first nip and a liquid toner supply located under said laser printhead, a first transfer roller positioned to form a second nip with said photoconductive roller at which said toned image is transferred to said first transfer roller, said second nip being generally opposite said laser printhead, a second transfer roller of diameter one-third or less of the diameter of said first roller positionable above said first transfer roller to form a third nip with said first transfer roller at which said toned image is transferred to said second transfer roller, a third roller positioned to form a fourth nip with said second transfer roller, and paper feed means to move paper or other image receiving substrate to said fourth nip where said paper or other substrate receives said image while said paper is moved to exit said apparatus on to said output tray, said output tray being readily accessible to an operator of said printer positioned at said front of said printer.

4. The printer as in claim 3 having a paper supply chamber at the bottom of said printer and a vertical paper feed path at the back of said printer.

5. An electrophotographic printer comprising an endless photoconductive surface moveable in one direction, an output tray located at the top, front of said printer, means for charging said photoconductive surface, a laser printhead located under said output tray for exposing said charged surface to an optical image to at least partially discharge said charged surface in the pattern of said images, said laser printhead being located on said front side of said printer between said front of said printer and said photoconductive surface, means to develop said image on said photoconductive surface by applying liquid toner to said photoconductive surface from a location at which liquid from said means to develop moves under gravity with the movement of the photoconductive surface, an endless first transfer roller to receive said toned image from said photoconductive surface by contact with said photoconductive surface, an endless second transfer roller of diameter one-third or less of the diameter of said first roller positionable above said first transfer roller to receive said toned image from said first transfer roller by contact with said first transfer roller, a third roller positioned to form a first nip with said second transfer roller, and paper feed means to move paper or other image receiving substrate to said first nip where said paper or other substrate receives said image while said paper is moved to exit said printer at a location generally above the location of said laser printhead and said photoconductive surface on to said output tray, said output tray being readily accessible to an operator of said printer positioned at said front of said printer.

6. The printer as in claim 5 having a paper supply chamber at the bottom of said printer and a vertical paper feed path at the back of said printer.

* * * * *